US007322165B2

(12) United States Patent
Spether

(10) Patent No.: US 7,322,165 B2
(45) Date of Patent: Jan. 29, 2008

(54) CLOSING CONE

(75) Inventor: Karl-Heinz Spether, Ilvesheim (DE)

(73) Assignee: ALCOA Deutschland GmbH (DE)

( * ) Notice: Subject to any disclaimer, the term of this patent is extended or adjusted under 35 U.S.C. 154(b) by 0 days.

(21) Appl. No.: 10/522,048

(22) PCT Filed: Jun. 17, 2003

(86) PCT No.: PCT/EP03/06371

§ 371 (c)(1),
(2), (4) Date: Jul. 26, 2005

(87) PCT Pub. No.: WO2004/009484

PCT Pub. Date: Jan. 29, 2004

(65) Prior Publication Data

US 2006/0162286 A1 Jul. 27, 2006

(30) Foreign Application Priority Data

Jul. 19, 2002 (DE) ..... 102 32 846

(51) Int. Cl.
*B65B 7/28* (2006.01)

(52) U.S. Cl. ..... 53/331.5; 53/317; 53/329; 53/356; 53/490

(58) Field of Classification Search ..... 53/331.5, 53/329, 317, 331, 334, 344, 345, 346, 353–356
See application file for complete search history.

(56) References Cited

U.S. PATENT DOCUMENTS 1,773,259 A 8/1930 Cundall
2,076,631 A * 4/1937 Gantzer ..... 53/317
2,106,365 A 1/1938 Tiano
2,684,141 A 7/1954 Pim
2,835,093 A * 5/1958 Ford et al. ..... 53/345
3,303,633 A 2/1967 Wilhere
3,460,311 A * 8/1969 Koll et al. ..... 53/488

(Continued)

FOREIGN PATENT DOCUMENTS

CH 687 759 A5 2/1997

(Continued)

OTHER PUBLICATIONS

International Search Report for PCT/EP2003/006371; ISA/EP; Mailed: Oct. 13, 2003.

(Continued)

*Primary Examiner*—Thanh Truong
(74) *Attorney, Agent, or Firm*—Harness, Dickey & Pierce, P.L.C.

(57) ABSTRACT

Proposed is a closing cone for screwing screw closures onto containers, particularly bottles, with a receiving part, with a pick ring coupled therewith in rotation-resistant manner and with a pick-up system. The closing cone is characterized in that the pick ring (5) is segmented and is provided with movable segments (17), and that an actuation system (65) is provided which cooperates with the segments (17) so as to create a variable inner diameter of the pick ring (5). Closing cone according to one of the preceding claims, characterized in that the actuation system (65) is provided with a cone-taper coupling between the receiving part (3) and at least one segment (17), and preferably all segments, of the pick ring (5).

20 Claims, 4 Drawing Sheets

U.S. PATENT DOCUMENTS

| | | | | | |
|---|---|---|---|---|---|
| 3,597,896 | A | * | 8/1971 | Koll et al. | 53/488 |
| 3,672,121 | A | * | 6/1972 | Kawaminani | 53/351 |
| 3,906,706 | A | * | 9/1975 | Conti | 53/331.5 |
| 3,984,965 | A | | 10/1976 | Sonnenberg | |
| 3,998,032 | A | * | 12/1976 | Koebbeman | 53/352 |
| 4,173,104 | A | * | 11/1979 | Koll | 53/201 |
| 4,178,733 | A | * | 12/1979 | Dankert | 53/331.5 |
| 4,295,320 | A | * | 10/1981 | Willingham | 53/201 |
| 4,309,859 | A | | 1/1982 | Schindel | |
| 4,745,729 | A | * | 5/1988 | Bethge et al. | 53/331.5 |
| 4,756,137 | A | | 7/1988 | Lanigan | |
| 4,905,447 | A | * | 3/1990 | Margaria | 53/317 |
| 5,417,031 | A | | 5/1995 | Bankuty et al. | |
| 5,467,527 | A | * | 11/1995 | Zanini et al. | 29/773 |
| 6,945,011 | B2 | * | 9/2005 | Hidding et al. | 53/167 |

FOREIGN PATENT DOCUMENTS

| | | |
|---|---|---|
| DE | 35 38 971 C2 | 5/1987 |
| DE | 39 12 324 A1 | 10/1990 |
| DE | 100 58 225 A1 | 5/2002 |
| GB | 784257 | 6/1956 |

OTHER PUBLICATIONS

International Preliminary Examination Report dated Aug. 23, 2004.

* cited by examiner

CLOSING CONE

CROSSREFERENCE TO RELATED APPLICATIONS

This application is a U.S. National Stage of International Application No. PCT/EP2003/006371, filed 17 Jun. 2003 and published in German on 29 Jan. 2004 as WO 2004/009484 A1. This application claims the benefit of German Application No. 102 32 846.3, filed 19 Jul. 2002. The disclosure of the above application is incorporated herein by reference.

DESCRIPTION

The invention relates to a closing cone for screwing screw closures onto containers, particularly bottles, in accordance with the present disclosure.

Closing cones of the kind addressed here are known. Their purpose is to apply screw closures onto containers. They present a receiving part and a pick ring coupled therewith in rotation-resistant fashion, the purpose of said pick ring being to grasp screw closures that are to be applied or screwed onto a container. The inner diameter of the pick ring is selected so that it can reliably pick up closures also when their outer diameter deviates somewhat from a pre-specified size. To apply screw closures onto containers, the closing cone grasps a screw closure, places it on the region of the container opening and then screws it on tightly. To this end, as a rule, to apply a screw closing cone, the closing cone is rotated while the container is held stationary. Con-ceivably, it is also possible to apply the screw closure by holding the closing cone so as to prevent rotation and rotating the container. By means of the closing cones of the kind addressed here, it is possible to apply or screw onto containers not only conventional screw closures for containers, particularly bottles, but also closures known as twist-off closures that are provided with a special thread which already after a short twisting holds the screw closure tightly on the container. It has been established that in many cases the desired closing or twisting torque is not yet sufficient, so that the desired, defined closed condition of the container cannot be attained. Moreover, in this case the predetermined opening torque is not attained.

The object of the invention is therefore to provide a closing cone with which a higher twisting torque can be applied to the screw closure that is to be screwed on.

To reach this objective, we propose a closing cone presenting the features in accordance with the present teachings. Said closing cone is characterized in that the pick ring is segmented and that the segments are movable. In addition, an actuation system is provided whereby the segments can be moved. In this manner, the pick ring can be provided with a variable inner diameter. It is thus possible, on the one hand, to ensure a large tolerance adjustment when applying the screw closure to the container and, on the other, to change the contact force of the pick ring against the screw closure in a manner such that an increased torque can be transferred to said closure so that the closure can be applied onto the container with a higher torque.

Particularly preferred is an embodiment of the closing cone characterized in that the actuation system has a cone-taper coupling between the receiving part and at least one segment, and preferably all segments, of the pick ring. This coupling is designed so that when the contact force between the closing cone and the container is high, the inner diameter of the pick ring is reduced enabling the screw closure to be held with a higher force. In this manner, it is possible to generate a higher torque when applying a screw closure to a container, namely when closing the container.

Other embodiments will become apparent from the sub-claims.

In the following, the invention will be explained in greater detail by reference to drawings of a first embodiment of a closing cone, in which.

Figure 1:
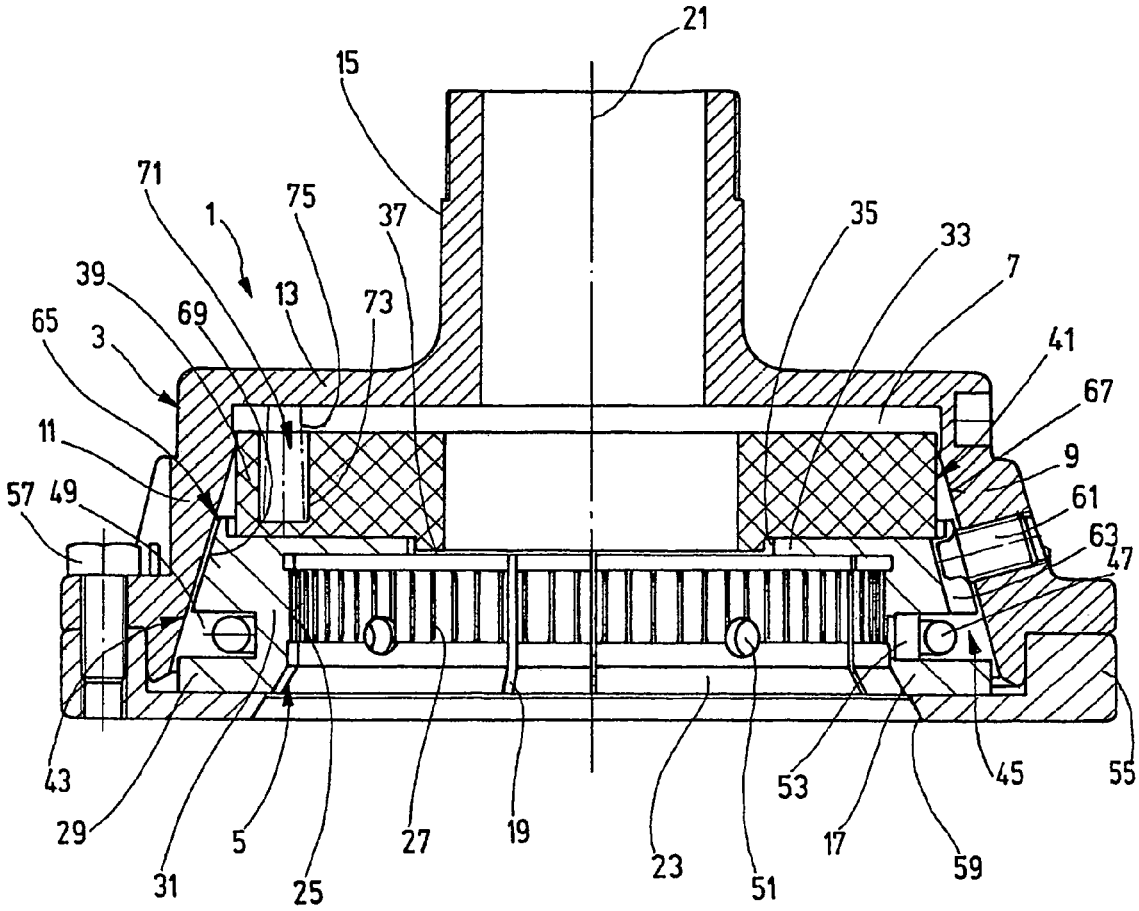
FIG. 1 shows a cross-section of a first embodiment of a closing cone.

The sectional representation in FIG. 1 shows a closing cone 1 in cross-section, with a receiving part 3 and a pick ring 5 coupled thereto. Receiving part 3 has a sleeve-shaped body 9 surrounding an internal space 7, said body having an essentially cylindrical jacket 11 and a bottom 13 from which extends a fastening part 15 intended for the purpose of attaching closing cone 1 to a closing machine.

Pick ring 5 is provided with at least two, here six, segments 17 which here are disposed at a distance from one another such that a slit 19 can be seen between every two adjacent segments. Segments 17 are disposed movably so that a variable inner diameter of pick ring 5 can be created, the segments being more or less displaceable relative to the central axis 21 of closing cone 1.

On its underside facing away from bottom 13 of receiving part 3, pick ring 5 is provided with a beveled intake 23 so that it can easily be attached to a screw closure for a container, not shown here, and so that the closure can be picked up, or grasped, by pick ring 5 and applied or screwed onto the container. Beveled intake 23 is created on all segments 17 of pick ring 5. Above beveled intake 23, the inner surface of pick ring 5 and, hence, that of segments 17 is essentially cylindrical and here, for example, provided with grooves 27 that are parallel to central axis 21 so that quasi-teeth can be formed on the inner surface 25 of segments 17 and thus of pick ring 5, said quasi-teeth forming part of a system for increasing the holding power of pick ring 5. Instead of the teeth, there can be provided on inner surface 25, for example, a plastic or rubber facing for the purpose of increasing the frictional and holding forces.

Segments 17 of pick ring 5 have a base 29 with a first segment 31 on the inside of which, facing central axis 21, the inner surface 25 is formed. A second segment 33 extends like a shoulder over inner surface 25 in the direction of central axis 21 leaving open an internal break-through 35.

Through said break-through extends annular seat 37 of a friction ring 39 of torque transmission means 41 disposed above pick ring 5 in inner space 7. Friction ring 39 preferably consists of a material whereby frictional forces can be transmitted to a screw closure disposed inside pick ring 5, said friction ring preferably consisting of a plastic material.

Pick ring 5 is part of a pick-up system 43 including at least one spring device acting on at least one of segments 17 of pick ring 5. Here, said spring device is provided with a spring ring 47 shaped like an O-ring, said spring ring being placed externally around segments 17 and preferably lodged in a notch 49 and being subjected to an initial stress. In this manner, all segments 17 are pushed in the direction of central axis 21, namely into a position of minimal inner diameter, but they can also be moved outward in a compliant manner when a screw closure, not shown here, is taken up into the free space enclosed by pick ring 5. The initial stressing force of spring ring 47 must be chosen so that when closing cone 1 is placed onto a screw closure, said cone can widen pick ring 5 when it touches bevel intake 23 that opens conically downward.

Segments 17 can additionally be provided with openings 51 which here are located at the bottom of notch 49 and open into the free space enclosed by pick ring 5. It is possible to introduce into notch 49 from the outside balls having an outer diameter greater than that of opening 51. Balls 53 are subjected by spring ring 47 to a compliant initial stress acting in the direction of central axis 21. In this manner, balls 53 can protrude slightly into the free space and exert additional holding forces on a picked-up screw closure. The balls thus constitute a part of pick-up system 43.

With a friction ring 39 that rests on the top side of pick ring 5, namely on second segment 33, pick ring 5 is held in inner space 7 by an end ring 55 which in an appropriate manner, here for example by means of screws 57, is attached from below to jacket 11 of receiving part 3 and has a central opening 59 through which a screw closure can reach the free space enclosed by pick ring 5. Preferably, the edge of opening 59 widens conically downward so as to facilitate the placement of closing cone 1 onto a screw closure. The inner diameter of opening 59 is smaller than the outer diameter of pick ring 5 so that said ring cannot fall out of inner space 7 through opening 59.

The free height provided between end ring 55 and the underside of bottom 13 is greater than the height of pick ring 5 and of friction ring 39 disposed thereon.

At least one of segments 17, and preferably all segments, are coupled with receiving part 3 in a manner resisting rotation. In the embodiment represented here, at least one screw 61 passing through jacket 11 of receiving part 3 in inner space 7 enters from the outside into a segment 17, said segment having a recess 63 in the outer surface, which permits relative movement of pick ring 5 upward in the direction of bottom 13 of receiving part 3, but prevents a relative rotational movement between receiving part 3 and pick ring 5. Recess 63 is preferably made in the outer surface of the notch provided in segment or segments 17. By means of screw 61, the movement clearance of segments 17 can be limited and a maximum inner diameter set for pick ring 5 by allowing screw 61 to rest on the outer side of segments 17.

Closing cone 1 is provided with an actuation system 65 intended for the purpose of varying the inner diameter of pick ring 5 and thus to permit tolerance adjustment over a wide range and, in addition, to vary the contact force of pick ring 5 against a screw closure taken up into the free space of said ring. Actuation system 65 is provided with a cone-taper coupling between receiving part 3 and pick ring 5. To this end, inner surface 67 of jacket 11 of receiving part 3 is conical in shape with the cone opening downward in the direction of end ring 55. Correspondingly, outer surface 69 of pick ring 5 is conical in shape, the cone angle being the same as that for inner surface 67 of receiving part 3.

By the cone-taper coupling, segments 17 are pressed together when pick ring 5 is pressed upward into inner space 7. The displacement path of pick ring 7 within inner space 7 is limited on one side by the width of slit 19: By the fact that pick ring 5 is displaced upward, segments 17 are displaced in the direction of central axis 21 so that the inner diameter of the free space enclosed by pick ring 5 is reduced. When all segments 17 lie close to each other and thus all slits 19 are pushed together, further relative movement between pick ring 5 and receiving part 3 is no longer possible. Moreover, the relative movement can be limited by adjusting the height between bottom 13 and end ring 55 to a desired value: When pick ring 5 is displaced upward, friction ring 39 finally makes contact with the underside of bottom 13.

Actuation system 65 is provided with a resetting device 71 that presses pick ring 5 downward against end ring 55 with a compliant force so that after a container is closed said end ring is forced into its starting position. Here, resetting device 71 is created, for example, by the fact that a recess 73, running approximately parallel to central axis 21, is provided in friction ring 39, a spring unit 75 in the form of a helical spring, here only indicated, being introduced into recess 73. Distributed over the periphery of friction ring 39 are preferably several such helical springs so that friction ring 39 is subjected to a uniform downward force.

The helical springs of spring unit 75 rest on one side on the base of recess 73 and on the other side on the underside of bottom 13. Friction ring 39 and, hence, also pick ring 5 are thus pressed downward until the underside of pick ring 5 is pressed against the top side of end ring 55.

When closing cone 1 is lowered onto a screw closure so that it comes to rest in the free space enclosed by pick ring 5, segments 17 are somewhat widened against the force exerted by spring system 45 so that the screw closure is held securely by pick ring 5. To close a container, the container is, as a rule, held stationary whereas the closing cone is made to rotate by means of the screw closure so as to screw said closure onto the container mouth, the closing cone 1 in this case being lowered relative to the container or the container being raised relative to closing cone 1. As a result, pick ring 5 together with friction ring 39 is pushed upward against the force exerted by resetting device 71, namely against the force of spring unit 75. In his manner, by the cone-taper coupling between receiving part 3 and pick ring 5, segments 17 are pressed in the direction of central axis 21 so that at first only the holding forces applied by spring unit 45 are increased by the cone-taper coupling of actuation system 65. Moreover, the inner surface of segments 17 that is provided with grooves 27 can engage with the teeth provided on the outside of the screw closure.

The torque applied by closing cone 1 to the screw closure is determined, on the one hand, by the pressing forces that press friction ring 39 against the screw closure located in the free space of pick ring 5, and, on the other, by the increasing holding forces of segments 17 exerted by actuation system 65.

Whereas the torque in current closing cones is determined exclusively by friction forces, here, on the one hand, the torque is predetermined by the holding forces of segments 17 of pick ring 5 and, on the other, by friction ring 39. The latter does not necessarily have to be provided, but it does increase the applicable torque.

When the screw closure is screwed or applied onto a container, closing cone 1 is raised from the container. In this manner, a relative movement between closing cone 1 and the closed container in the direction of central axis 21 can take place to an extent such that resetting device 71 can push friction ring 39 and pick ring 5 downward against end ring 55. Pick ring 5 thus ends up in a region of inner surface 67 in which the cone is wider. In other words, actuation system 65 no longer subjects segments 17 of pick ring 5 to an additional force acting in the direction of central axis 21 so that the closure is reliably released.

In the release position of actuation system 65 in which, at the bottom, pick ring 5 is situated in contact with end ring 55, only the holding forces built up by spring means 45 of pick-up system 43 are active. Said forces are exclusively intended to pick up a screw closure and to hold it until it is placed on the container. The forces are so small as to be negligible when a container is closed and the closing cone is lifted from the container. Exclusively relevant for the closing process are the holding forces of segments 17 of pick ring 5 predetermined by actuation system 65 and optionally the forces applied by friction ring 39 which through annular seat 37 are transmitted to the top side of a closure disposed in the free space within pick ring 5.

In view of all this, it is clear that the torque acting on a screw closure is affected also by the teeth present on the inner surface of segments 17.

Figure 2:
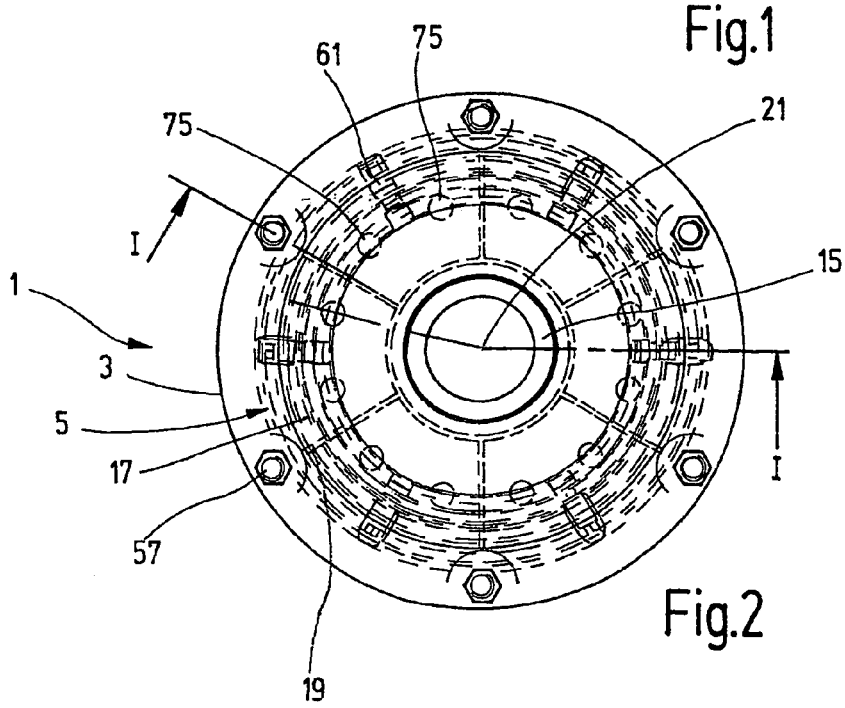
FIG. 2 shows a top view of the closing cone of FIG. 1.

FIG. 2 shows a top view of closing cone 1. Equal parts are indicated by the same reference numerals, the reader therefore being referred to the description of FIG. 1.

Line I-I shown in FIG. 2 indicates the direction of the section for the cross-sectional representation of FIG. 1. The representation in FIG. 2 shows a top view of receiving part 3. Segments 17 of pick ring 5 disposed inside receiving part 3 are indicated by broken lines. It is clearly discernible that here there are provided six segments of equal size each having an aperture angle of about 60°. Slits 19 present between the segments can also be seen. The top view shows that to each segment 17 there is assigned a screw 61 which here, to ensure clarity, is indicated by a reference numeral on only one segment. Because all segments are equal, the same is true for the other segments.

The top view shows that resetting device 71 is provided with spring units 75 two of which are assigned to each segment 17. This is indicated by circles.

Figure 3:
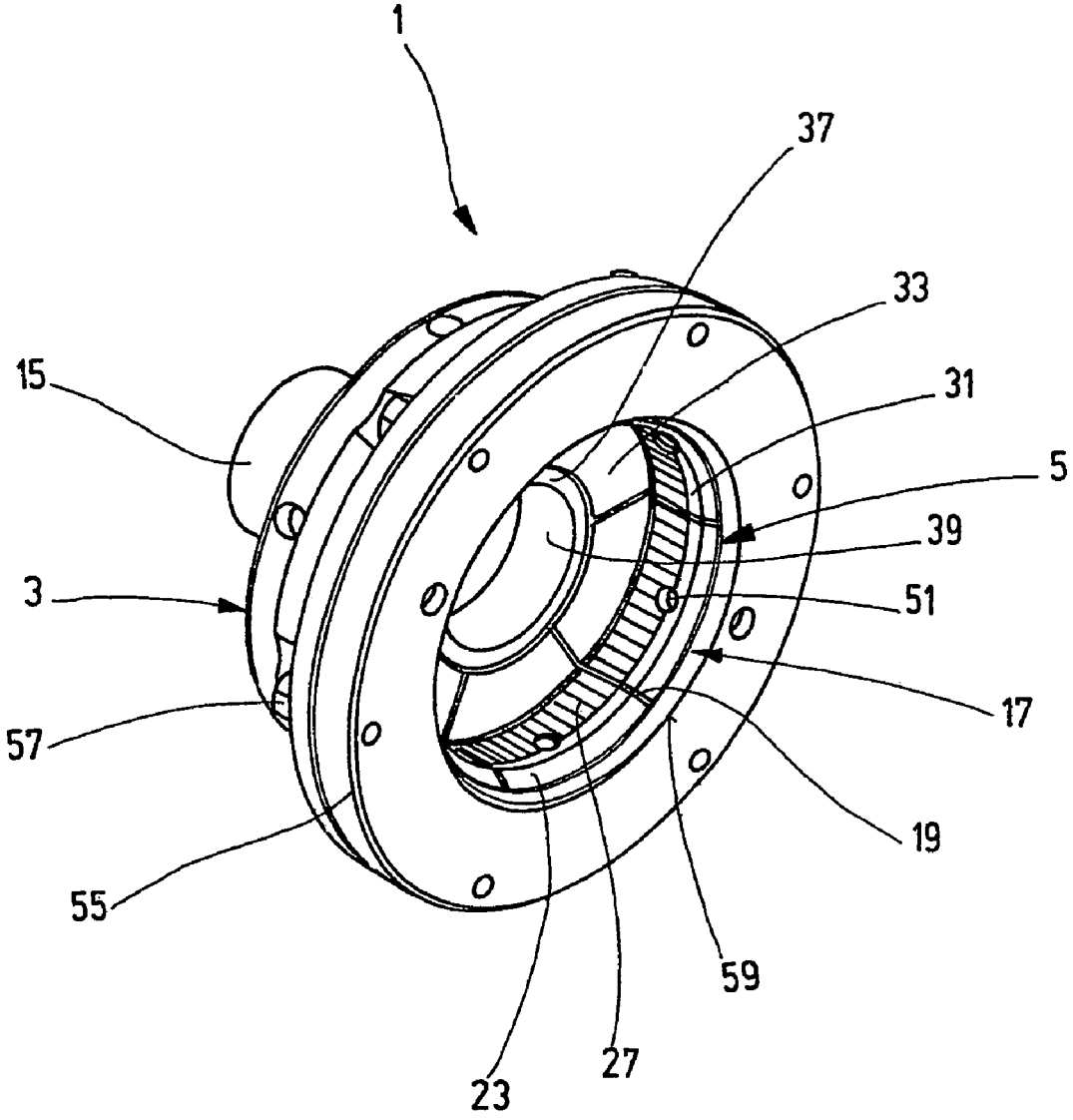
FIG. 3 is a bottom view in perspective of the closing cone.

Finally, FIG. 3 shows a perspective view from below of the embodiment of closing cone 1 represented in FIG. 1 so that the free space enclosed by pick ring 5 can readily be discerned. Equal parts are indicated by the same reference numerals, the reader therefore being referred to the explanations of FIGS. 1 and 2.

The drawing in FIG. 3 clearly shows segments 17 of pick ring 5, each provided with a beveled intake 23 so that a screw closure can be picked up in simple manner with closing cone 1, the screw closure then passing through opening 59 of end ring 55 and ending up in the free space. The figure also shows annular seat 37 of friction ring 39 which, upon application of a pressing force by closing cone 1 onto the screw closure, can engage the top side of said screw closure and transfer the torque. Here it is irrelevant, as also indicated by the foregoing explanations, whether a relative rotational movement between closing cone 1 and the container takes place as a result of rotation of the closing cone or of rotation of the container. It also becomes clear that a relative movement of closing cone 1 in the direction of central axis 21 can occur either by lowering closing cone 1 relative to a container or by raising the container relative to closing cone 1.

The height of the free space enclosed by pick ring 5 is selected so that at least the upper region of a screw closure that can be placed on a container is surrounded. Grooves 27 on the inner surface of segments 17 can be made to correspond to appropriate grooves on the outside of a screw closure thus increasing the maximum torque during the closing of a container.

The explanations for the embodiment of closing cone 1 represented in FIGS. 1 to 3 mention a friction ring 39. It was also stated that optionally this ring in not needed for the enhancement of the torque during the closing of a container. In this case, the friction ring can be left in closing cone 1 as a spacer ring or as part of resetting device 71 and thus act as a resetting ring. In this case, it is not necessary to provide friction between closing cone 1 and the material that serves to raise the grasped screw closure.

Figure 4:
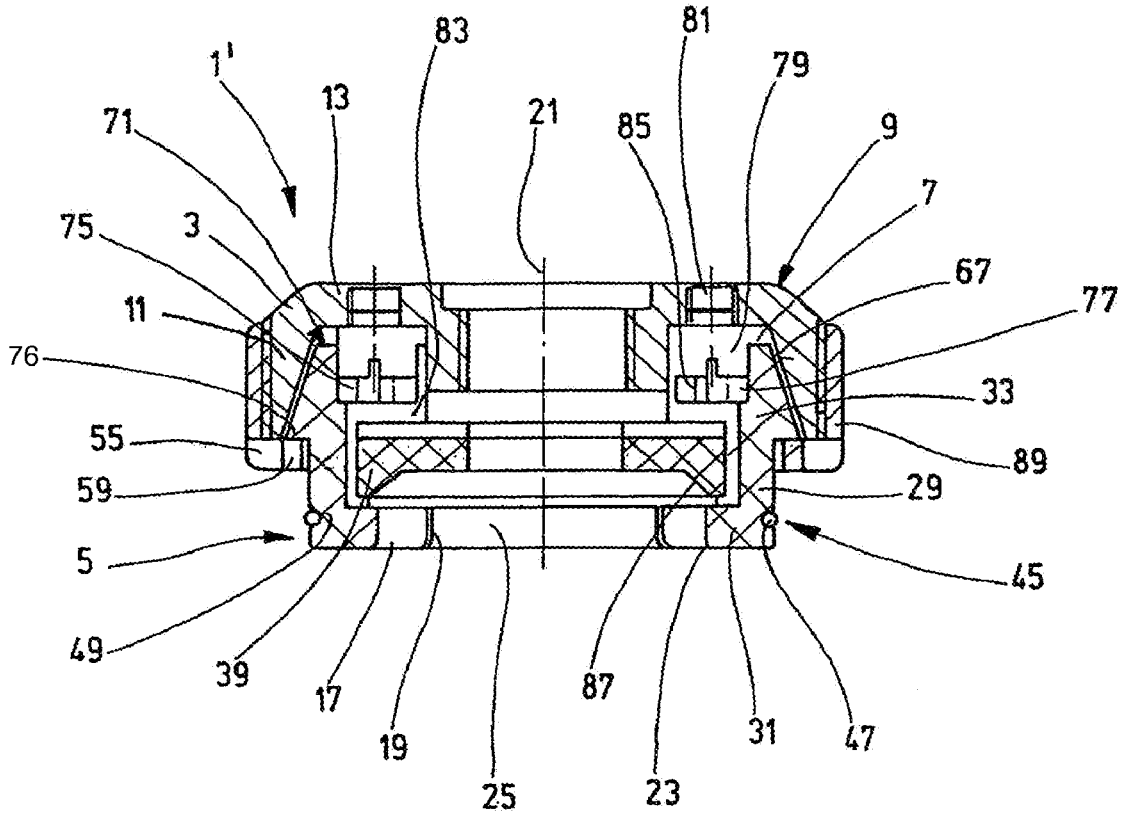
FIG. 4 shows a longitudinal cross-section of a second embodiment of a closing cone.

FIG. 4 shows a modified embodiment of a closing cone 1' in cross-section. Equal parts are indicated by the same reference numerals, the reader therefore being referred to the explanations of the preceding figures.

Closing cone 1' is thus provided with a receiving part 3 and a pick ring 5 that surrounds a number of segments 17. To obtain a variable inner diameter of the free space enclosed by pick ring 5, at least two segments are provided, as for closing cone 1. Here, too, as in the embodiment according to FIG. 1, there are provided six segments 17 separated from one another by a slit 19.

In the embodiment represented here, pick ring 5 is not completely accommodated in inner space 7 enclosed by receiving part 3. Base 29 of pick ring 5 has a first section 31 which has an essentially cylindrical peripheral surface and protrudes downward through a opening 59 in an end ring 55 terminating inner space 7 in the downward direction. Moreover, base 29 encloses a second section 33 which has a conical outer surface for the purpose of creating a cone-taper coupling of actuation system 65, said surface tapering off from bottom upward and interacting with the conical inner surface 67 provided on the inside of jacket 11 of body 9 of receiving part 3.

Second section 33 protrudes outward over the cylindrical outer surface of first section 31 giving rise to an arresting shoulder 76 with which at the top pick ring 5 rests on end ring 55, said pick ring 5 thus being held securely in inner space 7 of receiving part 3.

In the cylindrical outer surface of first section 31 of pick ring 5 is introduced into a groove 49 a spring ring 47 of a spring unit 45 so as to subject segments 17 to a force directed inward in the direction of central axis 21 which makes possible the pick-up or take-up of screw closures. To be able to grasp screw closures having different outer diameters that are based on dimensional tolerances, segments 17 are disposed in movable manner so that when a screw closure is picked up, slits 19 between the segments can be widened to varying widths.

Pick ring 5 encloses a friction ring 39 which from above presses on a picked-up screw closure and transmits an additional torque when a screw closure is placed on a container. Friction ring 39 is preferably made of a material capable of transmitting frictional forces to a screw closure located inside pick ring 5. Said friction ring is, for example, made of a plastic material.

Inside receiving part 3, pick ring 5 can be moved together with friction ring 39 against the force of resetting device 71 that comprises per segment at least one spring unit 75 which here once again can be in the form of a helical spring. Resetting device 71 serves to force pick ring 5 downward until said ring rests on end ring 55 and can be widened to a maximum when a screw closure is to be picked up. As in the embodiment represented in FIG. 1, the height of inner space 7 is selected so that pick ring 5 can be pressed upward against the force of resetting device 71 until either all segments 17 push against each other or pick ring 5 touches the underside of bottom 13.

Pick ring 5 is coupled with receiving part 3 in a manner that resists rotation. To this end, there are introduced into the pick ring or segments 17 thereof from above and running parallel to central axis 21 recesses 77 into each of which engages a screw head 79 of a screw 81 that is screwed from below into bottom 13 of receiving part 3 and that protrudes into inner space 7. Screw head 79 also extends vertically from above into a recess 85 provided in a receiving ring 83, said recess running parallel to central axis 21 and serving to ensure a rotation-resistant coupling between screw head 79 and receiving ring 83 which is disposed inside pick ring 5 and holds friction ring 39.

The radius of the underside of pick ring 5 is such that here, too, a beveled intake 23 is formed. Correspondingly, the underside of friction ring 39 is provided with a conical widening 87 ensuring the pick-up of a screw closure and the tightness of the screw connection.

It is clear from the explanations that the functioning of closing cone 1' is the same as that of closing cone 1 which was explained in connection with FIGS. 1 to 3: Pick ring 5 is provided with movable segments 17 held together by a spring unit 75 and serving the purpose of picking up a screw closure. When the screw closure is placed on a container and screwed on with a compressive force, pick ring 5 is displaced upward within receiving part 3 and against the resetting force of a resetting device 71 so that through the cone-taper coupling of actuation system 65 the movable segments are pressed with a force acting against the screw closure and in the direction of central axis 21. At the same time, friction ring 39 is pressed against the top side of the closure. Thus, there are two elements exerting a torque onto a screw closure when said screw closure is screwed or applied onto a container. Optionally, friction ring 39 may be omitted. Preferably, however, said ring is provided for the purpose of applying the desired closing torque.

Here inner surface 25 of pick ring 5 is cylindrical as far as the beveled intake 23 and, for example, has no grooves or teeth. Here, too, it is conceivable, however, to provide a system for increasing the holding power, namely grooves or teeth or a rubber covering that make it possible to increase the applicable torque when a container is being closed.

In the embodiment represented here, end ring 55 is held by a coupling nut 89 externally surrounding receiving part 3. In over-all terms, as a result of this arrangement, closing cone 1' is much more compact than closing cone 1 explained in connection with FIGS. 1 to 3. The outer arrangement of closing cone 1' in different cases of use and mounting is variable within a closure device. Critical is the segmented pick ring 5 that comprises movable segments 17 which as a result of a cone-taper coupling can by an actuation system 65 be subjected to a force for the purpose of varying the inner diameter of pick ring 5 and safely holding said ring on the screw closure. In this manner, when a container is closed, not only can tolerances be adjusted within a wide range, but the torque can also be markedly increased.

Figure 5:
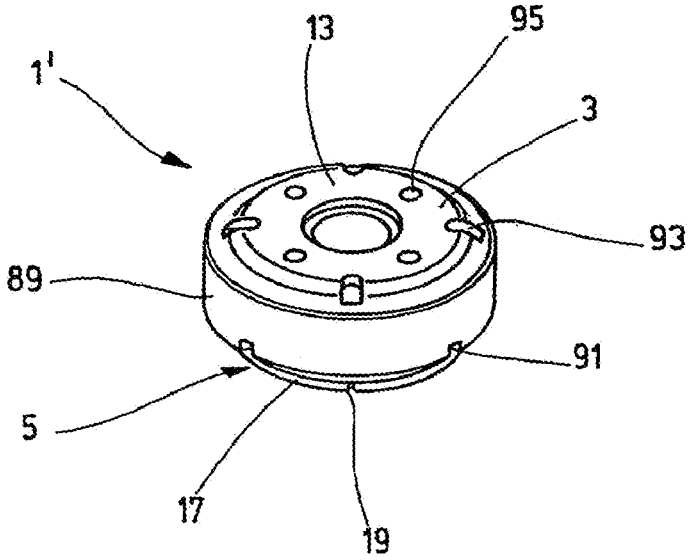
FIG. 5 is a top view in perspective of the closing cone of FIG. 4.

FIG. 5 shows an inclined perspective view of closing cone 1' from above. Equal parts are indicated by the same reference numerals, the reader therefore being referred to the description for FIG. 4. The drawing clearly shows the smooth outer shape of closing cone 1' imparted by coupling nut 89 which on its underside encloses engaging grooves 91. Correspondingly, receiving part 3 is provided on its outside with engagement grooves 93 to enable relative rotation between coupling nut 89 and receiving part 3. Bottom 13 of receiving part 3 contains four holes 95 provided with an inner thread into which screws 81 engage. At the bottom, one can see segments 17 of pick ring 5 separated by a slit 19.

Figure 6:
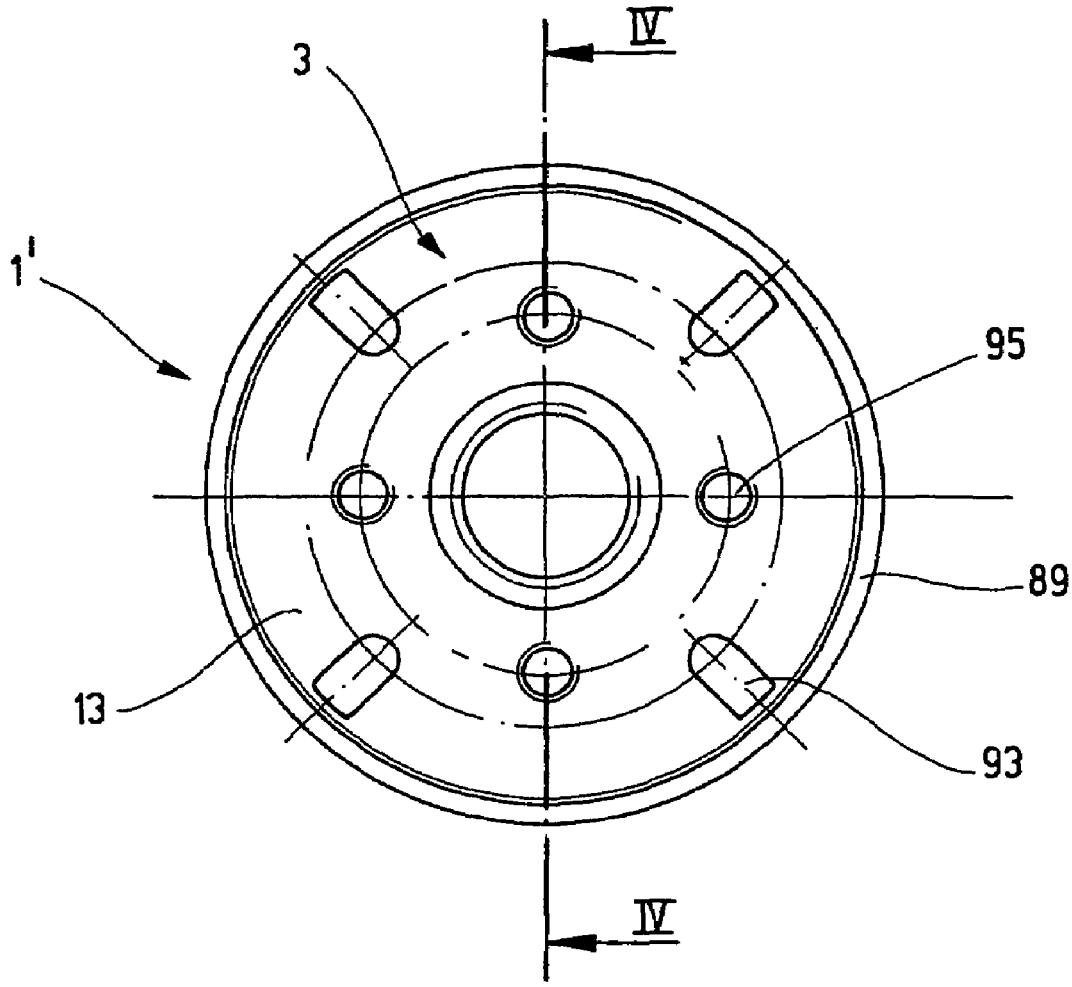
FIG. 6 is a top view of the closing cone of FIG. 4.

FIG. 6 shows a top view of closing cone 1'. Equal parts are indicated by the same reference numerals, the reader therefore being referred to the description of FIGS. 4 and 5. Line IV-IV indicates the course of the section through the representation of FIG. 4.

The top view shows bottom 13 of receiving part 3, moreover four holes 95 for screws 81, and four engagement grooves 93 intended for the purpose of screwing together receiving part 3 and coupling nut 89.

This representation, too, shows once again the compact, smooth outer shape of closing cone 1' which, by the way, because of its flat headroom is used mostly for twist-off closures.

The height of segments 17 of pick ring 5, however, can also be selected so as to enclose a free space the height of which is the same as that of the free space of the embodiment according to FIG. 1.

In other words, in both cases it is critical that the receiving part and the pick ring be characterized by an actuation system 65 that subjects the movable segments 17 of the pick ring to a force making it possible to obtain a variable inner diameter of pick ring 5 and thus to provide a tolerance adjustment and an increase in torque during the closing of containers. A system for transferring torque and having a friction ring 39 can also be provided. It is critical that when the closing cone is pressed onto a container during the closing operation, the actuation system 65 by means of the cone-taper coupling build up additional forces that are reversible: Resetting device 71 again cancels the additional forces when the closing cone is no longer pressed onto the container. In this manner, a screw closure applied onto a container is reliably released, because then only the pick-up forces applied by pick-up system 43 are active.

Closing cone 1, 1' can be adapted to a wide variety of closures. It can be used to apply screw closures and twist-off closures to any containers, particularly bottles.

The invention claimed is:

1. A closing cone for screwing closures onto containers, comprising:

a receiving part having an inner surface that defines a generally conical shape;

a pick ring disposed at least partially in said receiving part, said pick ring including a plurality of movable segments, each of said movable segments having a surface that defines a conical shape complementary to said inner surface of said receiving part and that establishes a cone-taper coupling between said pick ring and said receiving part;

an actuation system that at least one of adjusts said movable segments to establish a maximum an inner diameter of said pick ring and limits motion between said pick ring and said receiving part generally along a central axis of the closing cone;

a pick-up system including a spring system that establishes a biasing force on said movable segments of said pick ring toward said central axis of the closing cone, wherein said movable segments of said pick ring are operable to expand against said biasing force of said spring system to accept one of the closures; and said pick ring operable to move relative to said receiving part generally along said central axis of the closing cone to close the cone-taper coupling and squeeze together said movable segments of said pick ring;

wherein said spring system holds at least one ball in an opening formed in at least one of said moveable segments and wherein a portion of said ball extends into said inner diameter of said pick ring.

2. The closing cone of claim 1 wherein said spring system includes a spring ring that engages said plurality of movable segments.

3. The closing cone of claim 1 wherein said actuation system includes a resetting device that moves said pick ring relative to said receiving part to open said cone-taper coupling.

4. The closing cone of claim 1 further comprising a screw held by said receiving part, a portion of said screw extends toward one of said moveable segments and a portion of said screw is accessible from an exterior of said receiving part, wherein said screw can be selectivity adjusted to limit a degree of closure of said cone-taper coupling.

5. The closing cone of claim 1 wherein at least one of said moveable segments includes a beveled intake portion operable to direct the closure into said pick ring.

6. The closing cone of claim 1 further comprising a friction ring disposed between said pick ring and said receiving part and operable to exert a torque force on the closure.

7. The closing cone of claim 1 wherein an inner surface of said pick ring includes grooves that are generally parallel to said central axis of the closing cone.

8. The closing cone of claim 1, wherein said at least one ball includes a plurality of balls.

9. The closing cone of claim 1, wherein said at least one ball has an outer diameter greater than a diameter of said opening.

10. The closing cone of claim 1, wherein a spring device biases said at least one ball to extend into said inner diameter.

11. The closing cone of claim 10, wherein said spring device allows the cone to widen said pick ring when placed on a screwing closure.

12. A closing cone for screwing closures onto containers, comprising:

a receiving part having an inner surface that defines a generally conical shape;

a pick ring disposed at least partially in said receiving part, said pick ring including a plurality of movable segments, each of said movable segments having a surface that defines a conical shape complementary to said inner surface of said receiving part and that establishes a cone-taper coupling between said pick ring and said receiving part;

an actuation system that at least one of adjusts said movable segments to establish a maximum an inner diameter of said pick ring and limits motion between said pick ring and said receiving part generally along a central axis of the closing cone;

a pick-up system including a spring system that establishes a biasing force on said movable segments of said pick ring toward said central axis of the closing cone, wherein said movable segments of said pick ring are operable to expand against said biasing force of said spring system to accept one of the closures; and said pick ring operable to move relative to said receiving part generally along said central axis of the closing cone to close the cone-taper coupling and squeeze together said movable segments of said pick ring;

wherein said actuation system includes a reselling device that moves said pick ring relative to said receiving part to open said cone-taper coupling.

13. A closing cone for screwing closures onto containers of claim 12, further comprising a friction ring disposed between said pick ring and said receiving part, said resetting device includes a recess provided in said friction ring and a spring unit introduced into said recess.

14. A closing cone of claim 12, wherein said spring unit is in the form of a helical spring.

15. A closing cone of claim 13, comprising a plurality of helical springs distributed over a periphery of said friction ring to provide a uniform downward force to said friction ring.

16. A closing cone for screwing closures onto containers, comprising:

a receiving part having an inner surface that defines a generally conical shape;

a pick ring disposed at least partially in said receiving part, said pick ring including a plurality of movable segments, each of said movable segments having a surface that defines a conical shape complementary to said inner surface of said receiving part and that establishes a cone-taper coupling between said pick ring and said receiving part;

an actuation system that at least one of adjusts said movable segments to establish a maximum an inner diameter of said pick ring and limits motion between said pick ring and said receiving part generally along a central axis of the closing cone;

a pick-up system including a spring system that establishes a biasing force on said movable segments of said pick ring toward said central axis of the closing cone, wherein said movable segments of said pick ring are operable to expand against said biasing force of said spring system to accept one of the closures; and said pick ring operable to move relative to said receiving part generally along said central axis of the closing cone to close the cone-taper coupling and squeeze together said movable segments of said pick ring; and a screw held by said receiving part, a portion of said screw extends toward one of said moveable segments and a portion of said screw is accessible from an exterior of said receiving part, wherein said screw can be selectivity adjusted to limit a degree of closure of said cone-taper coupling.

17. A closing cone for screwing closures onto containers, comprising:

a receiving part having an inner surface that defines a generally conical shape;

a pick ring disposed at least partially in said receiving part, said pick ring including a plurality of movable segments, each of said movable segments having a surface that defines a conical shape complementary to said inner surface of said receiving part and that establishes a cone-taper coupling between said pick ring and said receiving part;

an actuation system that at least one of adjusts said movable segments to establish a maximum an inner diameter of said pick ring and limits motion between said pick ring and said receiving part generally along a central axis of the closing cone;

a pick-up system including a spring system that establishes a biasing force on said movable segments of said pick ring toward said central axis of the closing cone, wherein said movable segments of said pick ring are operable to expand against said biasing force of said spring system to accept one of the closures;

said pick ring operable to move relative to said receiving part generally along said central axis of the closing cone to close the cone-taper coupling and squeeze together said movable segments of said pick ring; and a friction ring disposed between said pick ring and said receiving part and operable to exert a torque force on the closure.

18. The closing cone for screwing closures onto containers of claim 17, wherein the friction ring rests on a top side of said pick ring.

19. The closing cone for screwing closure onto containers of claim 17, wherein said friction ring transfers frictional forces to a screw closure disposed inside said pick ring.

20. The closing cone for screwing closure onto containers of claim 17, wherein said friction ring is constructed of a plastic material.

* * * * *